US008382009B2

(12) United States Patent
Wang

(10) Patent No.: US 8,382,009 B2
(45) Date of Patent: Feb. 26, 2013

(54) PERCUSSIVE SPRINKLER WITH ADJUSTABLE DISCHARGE ANGLE

(76) Inventor: Cheng-An Wang, Lu Kang Town (TW)

( * ) Notice: Subject to any disclaimer, the term of this patent is extended or adjusted under 35 U.S.C. 154(b) by 218 days.

(21) Appl. No.: 12/912,984

(22) Filed: Oct. 27, 2010

(65) Prior Publication Data

US 2012/0104116 A1 May 3, 2012

(51) Int. Cl.
*B05B 3/08* (2006.01)

(52) U.S. Cl. ..... 239/236; 239/97; 239/225.1; 239/230; 239/275; 239/DIG. 1

(58) Field of Classification Search ..... 239/97, 239/225.1, 230–233, 236, 273, 275, 76
See application file for complete search history.

(56) References Cited

U.S. PATENT DOCUMENTS 3,878,990 A * 4/1975 Geraudie ..... 239/236
4,198,001 A * 4/1980 Rodriguez ..... 239/236
4,637,549 A * 1/1987 Schwartzman ..... 239/230
5,769,322 A * 6/1998 Smith ..... 239/236
6,834,814 B1 * 12/2004 Beckman ..... 239/225.1

* cited by examiner

*Primary Examiner* — Steven J Ganey
(74) *Attorney, Agent, or Firm* — Egbert Law Offices, PLLC

(57) ABSTRACT

A percussive sprinkler with adjustable discharge angle has a pedestal, adjusting ring, main body, percussion guide frame and sprinkler head driving rod. The percussive sprinkler is characterized by that, the height of the spacing for the driving rod retaining surface of the adjusting ring can be adjusted via an adjustor, such that the second end on the sprinkler head driving rod connected to the sprinkler head is abutted onto the driving rod retaining surface. When the main body of the percussive sprinkler is rotated, the sprinkler head driving rod will shift vertically along the circumferential path on the driving rod retaining surface, so the sprinkler head is driven to swing vertically with change of the discharge angle. In such a case, spray with different sprinkling distance can be generated by the sprinkler head, thus making up the shortcomings for more uniform sprinkling coverage with higher flexibility and applicability.

7 Claims, 7 Drawing Sheets

PERCUSSIVE SPRINKLER WITH ADJUSTABLE DISCHARGE ANGLE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a percussive sprinkler, and more particularly to an innovative one which is configured to adjust the discharge angle in the rotation process.

2. Description of Related Art Including Information Disclosed Under 37 CFR 1.97 and 37 CFR 1.98.

The common sprinkler (referred to an auto-rotate percussive sprinkler) for gardening irrigation is generally composed of a main body, inlet tube, upper frame, guide assembly and outlet tube. The outlet tube is located obliquely at one side of the sprinkler's main body, such that when water flow is guided into the inlet tube and sprayed out from the outlet tube, a parabolic water column will be formed, and auto-rotate sprinkling is generated in combination with the guide assembly for the desired irrigation purpose.

However, it is found from actual applications that, when the common sprinkler is actuated for sprinkling and water flow is sprayed out from the outlet tube, a parabolic sprinkling distance is formed due to oblique arrangement of the outlet tube. Meanwhile, circular or oriented sprinkling is generated via arrangement of the guide assembly. Yet, in view of the fixed oblique arrangement of the sprinkler's outlet tube, the sprinkling distance is limited, making it impossible to meet diversified irrigation requirements. For this reason, a percussive sprinkler with adjustable discharge angle has been developed, namely, the discharge angle of the sprinkler head can be pre-adjusted to change the parabolic sprinkling distance of water flow.

As a single discharge angle is maintained during rotation of said percussive sprinkler with adjustable discharge angle, it is impossible to realize flexible irrigation in fast-growing gardening sectors, leading to uneven sprinkling/irrigation and poorer cultivation of agricultural crops.

BRIEF SUMMARY OF THE INVENTION

The enhanced efficacy of the present invention is as follows:

Based on the unique configuration of the present invention wherein the "percussive sprinkler" mainly comprises a pedestal, adjusting ring, main body, percussion guide frame and sprinkler head driving rod, the height of the spacing for the driving rod retaining surface can be adjusted freely, such that the sprinkler head driving rod will shift vertically along the circumferential path on the driving rod retaining surface, and the sprinkler head is driven to swing with change of the discharge angle. In such a case, spray with different sprinkling distance can be generated by the sprinkler head, thus making up the shortcomings for more uniform sprinkling coverage with higher flexibility and applicability.

DETAILED DESCRIPTION OF THE INVENTION

Figure 1:
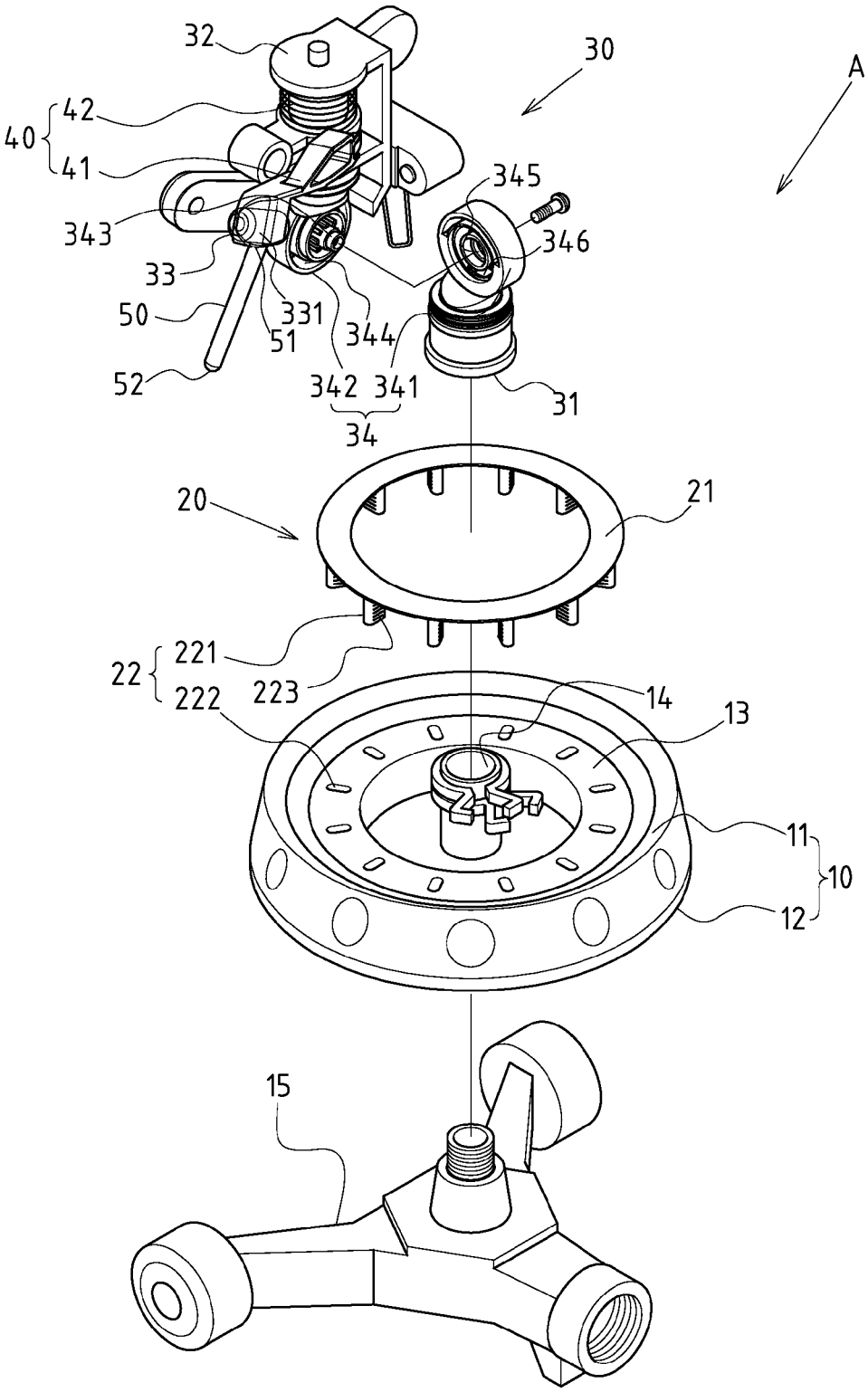
FIG. 1 is an exploded perspective view of the preferred embodiment of the present invention.
Figure 2:
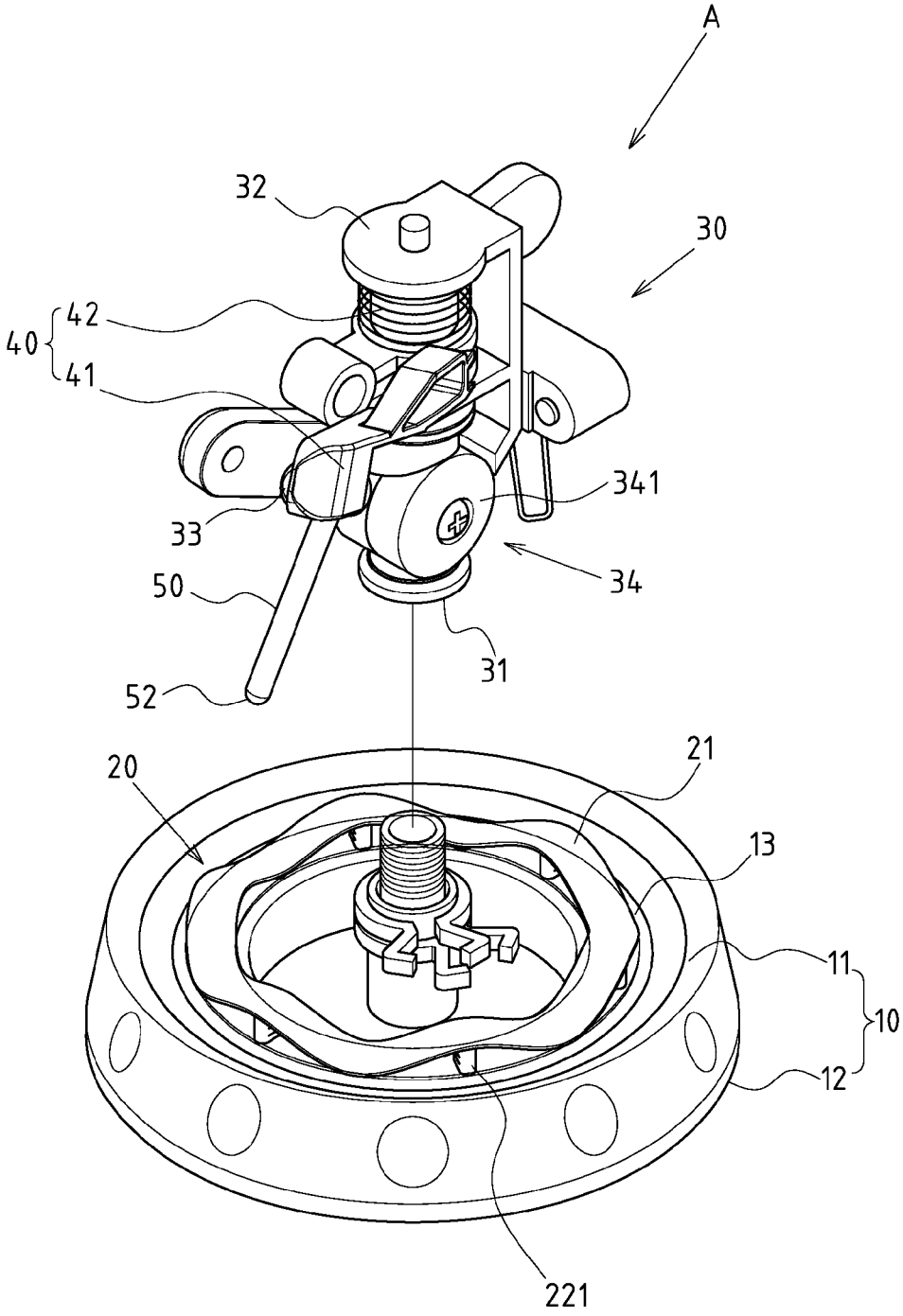
FIG. 2 is a partial exploded perspective view of the preferred embodiment of the present invention.
Figure 3:
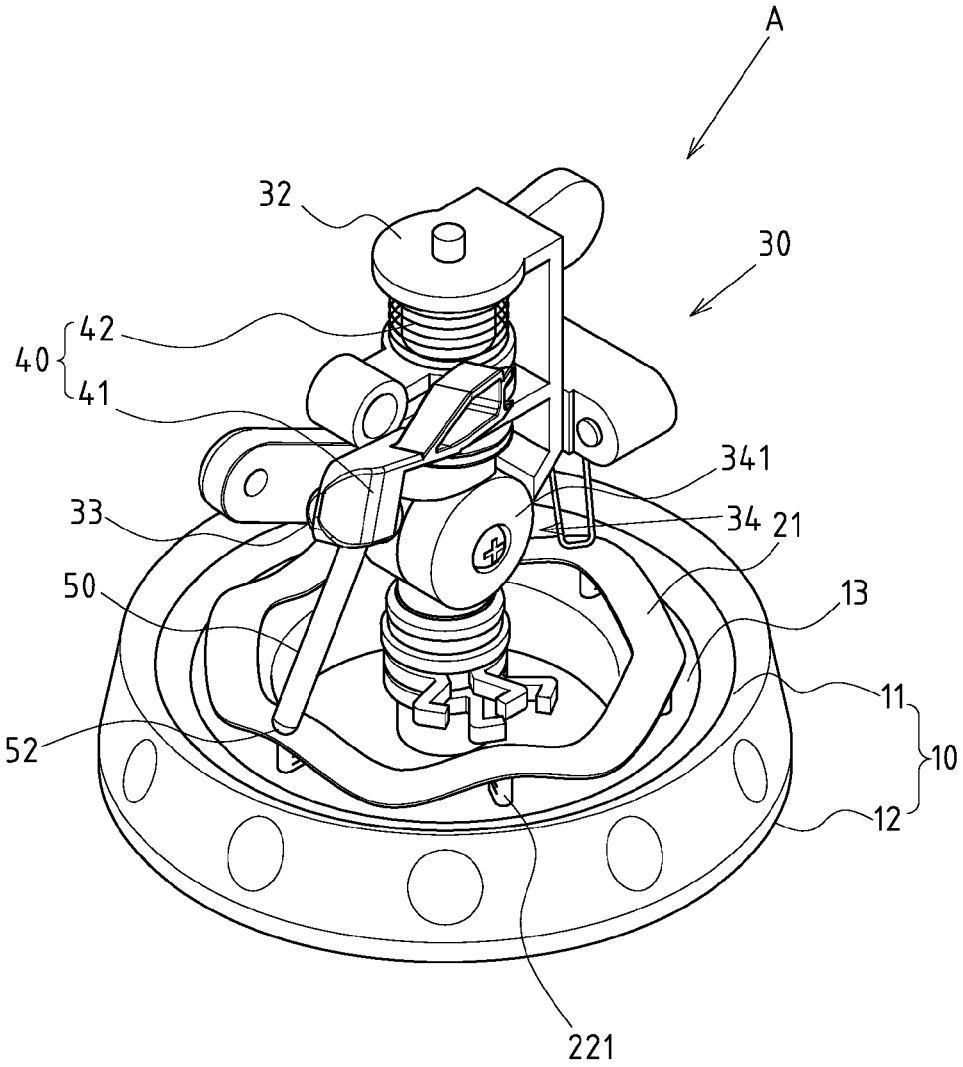
FIG. 3 is a partial assembled perspective view of the preferred embodiment of the present invention.

FIGS. 1-4 depict preferred embodiments of a percussive sprinkler of the present invention with adjustable discharge angle. The percussive sprinkler A includes a pedestal 10 with a top and a bottom 11, 12. The top 11 of the pedestal 10 is provided with a setting surface 13 and an inlet tube 14 penetrating the top and bottom 11, 12 of the pedestal 10. A foot stand 15 is assembled at the bottom of the pedestal 10.

An adjusting ring 20 is set onto the setting surface 13 of the pedestal 10. The adjusting ring 20 includes at least a circular driving rod retaining surface 21, which allows an adjustor 22 to adjust freely the height of the spacing.

A main body 30 with an inlet tube mating end 31 is set at its lower end and an upper frame 32 at its upper end. The inlet tube mating end 31 is assembled at the inlet tube 14 of the pedestal 10, and a sprinkler head 33 is protruded close to the lower flange of the upper frame 32. A circumferential flange 331 is defined on the sprinkler head 33.

A percussion guide frame 40 is assembled flexibly onto the upper frame 32 of the main body 30. A hydraulic pusher 41 and a torsional spring 42 are set at one side of the percussion guide frame 40. The hydraulic pusher 41 is located at interval onto front end of the sprinkler head 33 of the main body 30.

A sprinkler head driving rod 50 is defined into a first end 51 and a second end 52. The first end 51 is linked to the circumferential flange 331 of the sprinkler head 33, and the second end 52 abutted onto the driving rod retaining surface 21 for the adjusting ring 20.

With this configuration, when the main body 30 of the percussive sprinkler A is rotated, the sprinkler head driving rod 50 will shift vertically along the circumferential path on the driving rod retaining surface 21 of the adjusting ring 20, so the sprinkler head 33 is driven to swing vertically with change of the discharge angle.

Of which, the first end 51 of the sprinkler head driving rod 50 is linked to the lateral part or bottom of the circumferential flange 331 of the sprinkler head 33. In the preferred embodiment of the present invention, the first end 51 of the sprinkler head driving rod 50 is linked to the bottom of the circumferential flange 331 of the sprinkler head 33.

Of which, a swinging seat 34 is pivoted onto lower flange close to the upper frame 32. As shown in FIGS. 1-4, the swinging seat 34 has a fixed seat 341 and a rotary seat 342.

The rotary seat 342 is provided with a shaft lever 343 and a circumferential water passage 344. The fixed seat 341 is provided with a shaft hole 345 for sleeving the shaft lever 343 and a water inlet 346. Also, a sprinkler head 33 is protruded correspondingly from the preset location of the circumferential water passage 344 of the rotary seat 342, such that the main body 30 and the sprinkler head 33 can swing freely in tune with the swinging seat 34. Of which, the percussion guide frame 40 can be connected with either of the fixed seat 341 or rotary seat 342 of the swinging seat 34. As shown in FIG. 1, the percussion guide frame 40 is connected with the rotary seat 342.

Figure 5:
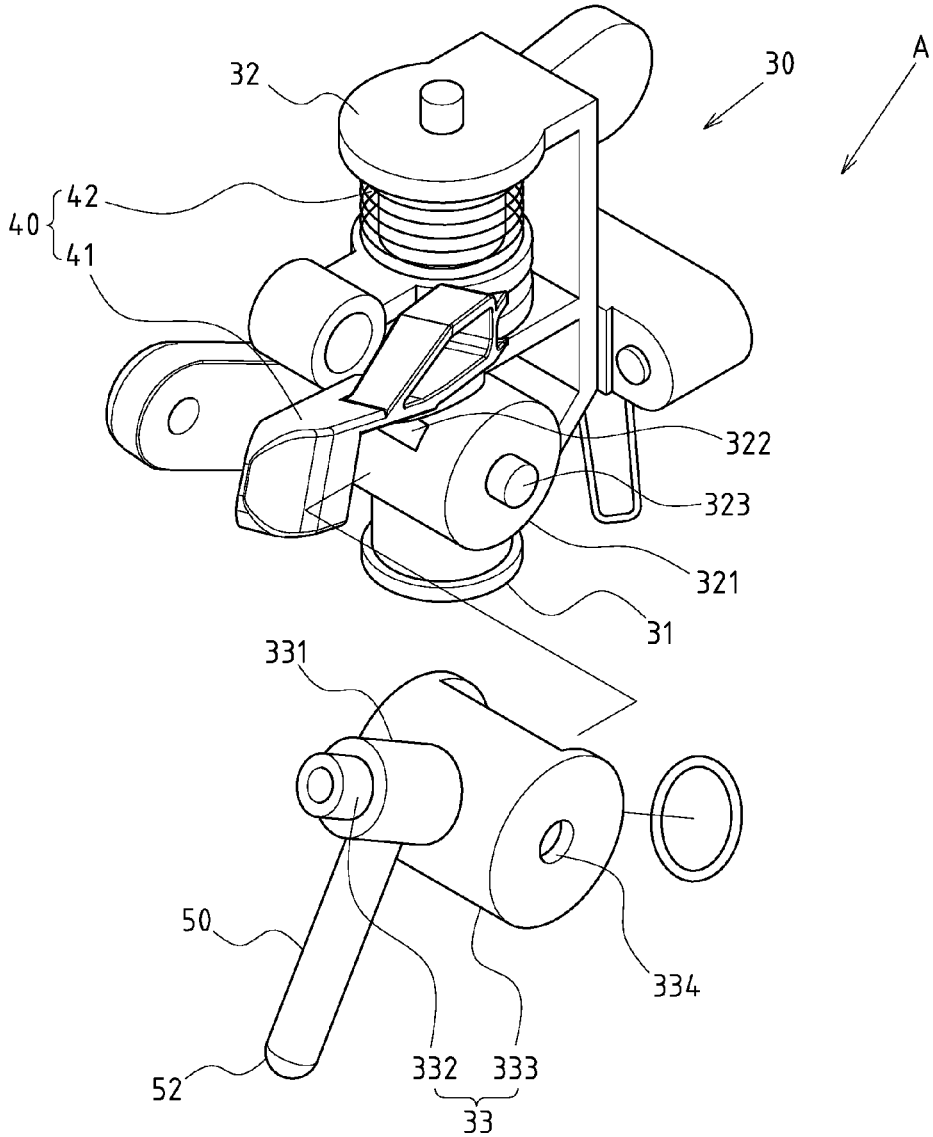
FIG. 5 is a partial exploded perspective view of the other preferred embodiment of the present invention.
Figure 6:
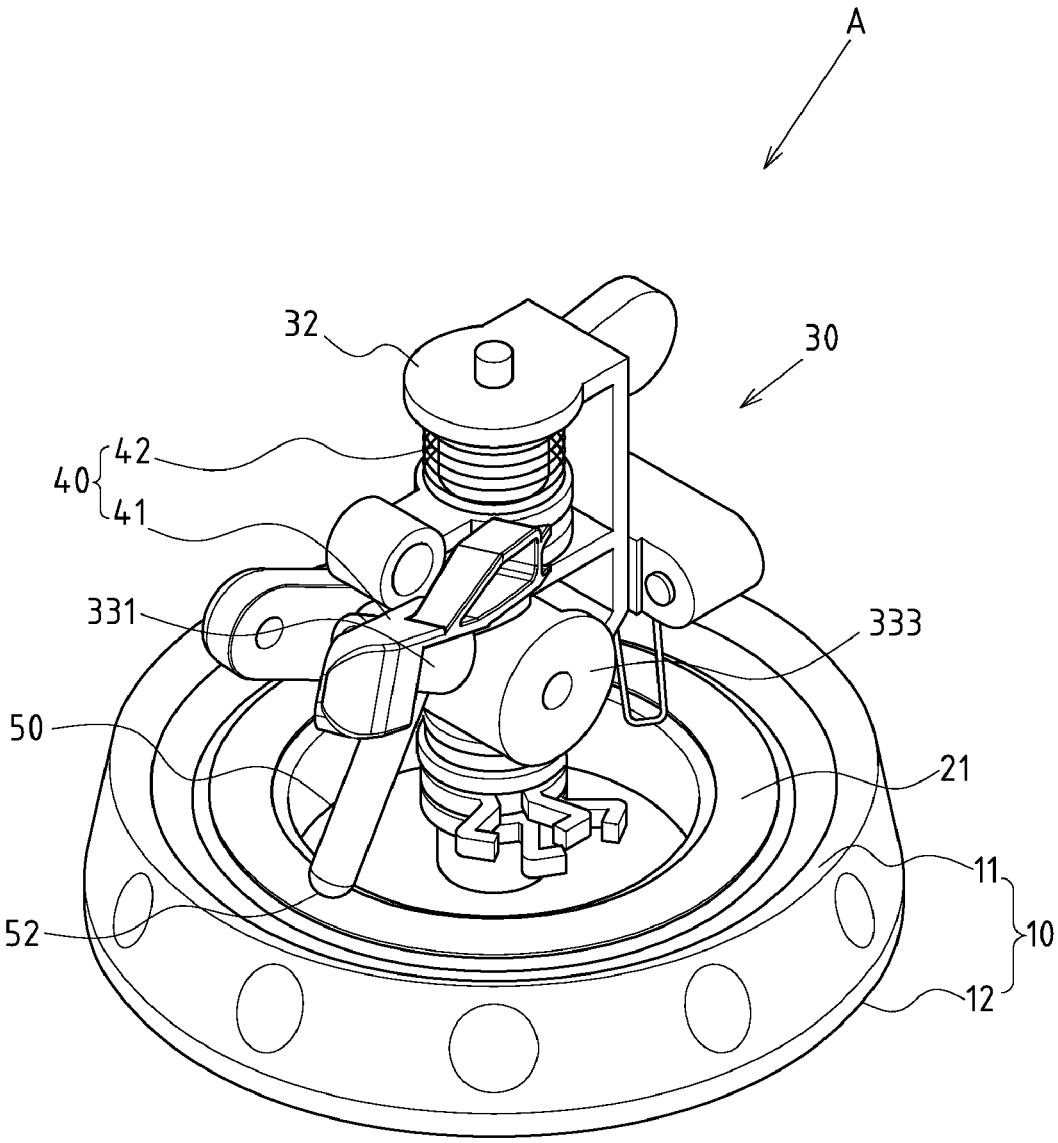
FIG. 6 is a partial assembled perspective view of the other preferred embodiment of the present invention.

Referring also to FIGS. 5 and 6, another preferred embodiment of the present invention is shown wherein a water inlet mating portion 321 is set onto lower flange close to the upper frame 32, so as to assemble the sprinkler head 33. The sprinkler head 33 has a rotary mating portion 333, which is provided with a locator 334. The water inlet mating portion 321 for the upper frame 32 has a water inlet 322 and a locating bulge 323 at both sides of the water inlet mating portion 321. When the sprinkler head 33 is mated with the water inlet mating portion 321, the locator 334 is snapped onto the locating bulge 323, enabling free swinging of the sprinkler head 33.

Of which, the adjusting ring 20 is of a circular disc pattern. The adjustor 22 is arranged at bottom of the adjusting ring 20 correspondingly to the setting surface 13. The adjustor 22 has an adjustable column 221 and a locating hole 222. The adjustable columns 221 are protruded downwards from the bottom of the adjusting ring 20, and distributed evenly at interval. Moreover, a plurality of gears 223 is formed at interval onto the adjustable column 221, whilst the locating hole 222 is arranged onto the setting surface 13, so that the adjustable column 221 can be locked by passing through the locating hole 222. The height of the adjustable column 21 can be adjusted by mating the gear 223 with the locating hole 222.

Based on above-specified structural configuration, the present invention is operated as follows:

In the actual applications, water flow firstly passes through the swinging seat 34 and enters into the main body 30 from the inlet tube mating end 31 at lower part of the main body 30, and then into the circumferential water passage 344 through the water inlet 346 of the swinging seat 34. Next, water flow is fed to the sprinkler head 33, enabling to impact the hydraulic pusher 41 of the percussion guide frame 40 to make it swing outwards. Then, the torsional spring 42 of the percussion guide frame 40 generates a torsional restoring force, enabling torsional resetting of the hydraulic pusher 41 for circumferential and deflecting sprinkling of the percussive sprinkler A.

Figure 4:
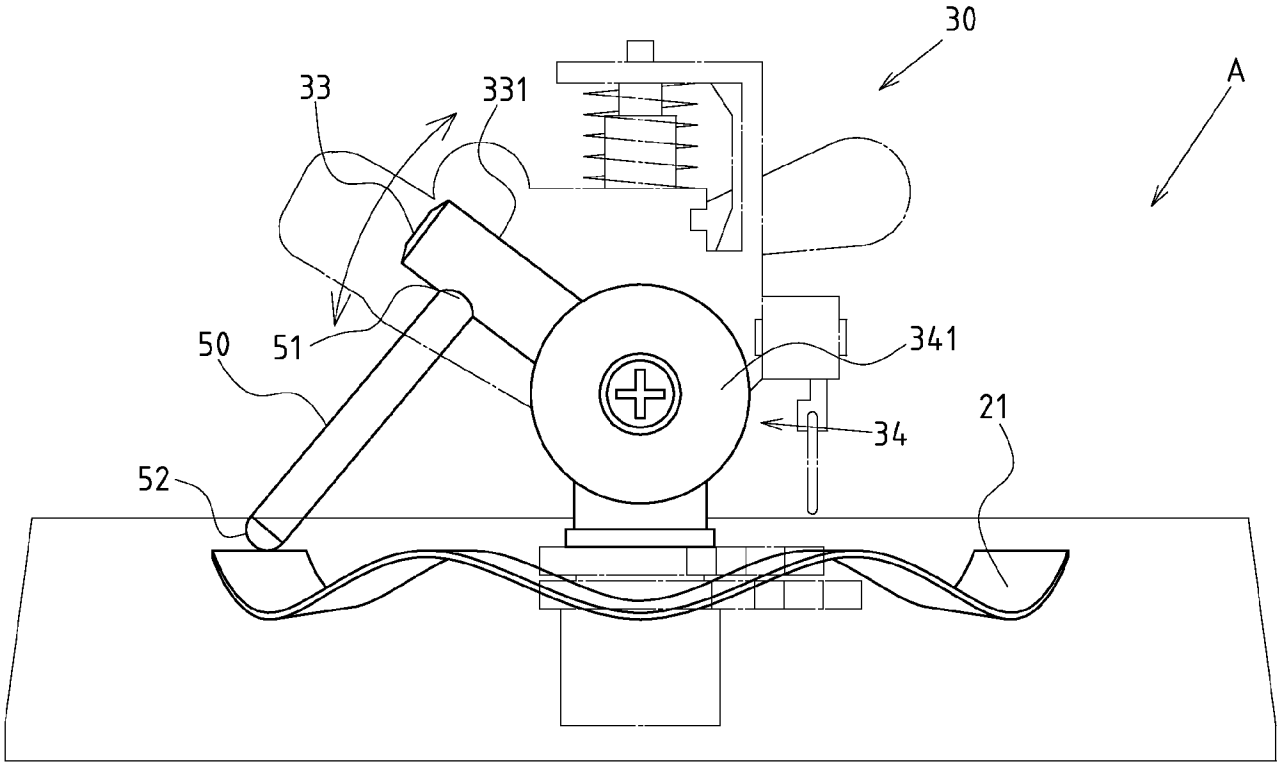
FIG. 4 is a partial plan view of the preferred embodiment of the present invention.
Figure 7:
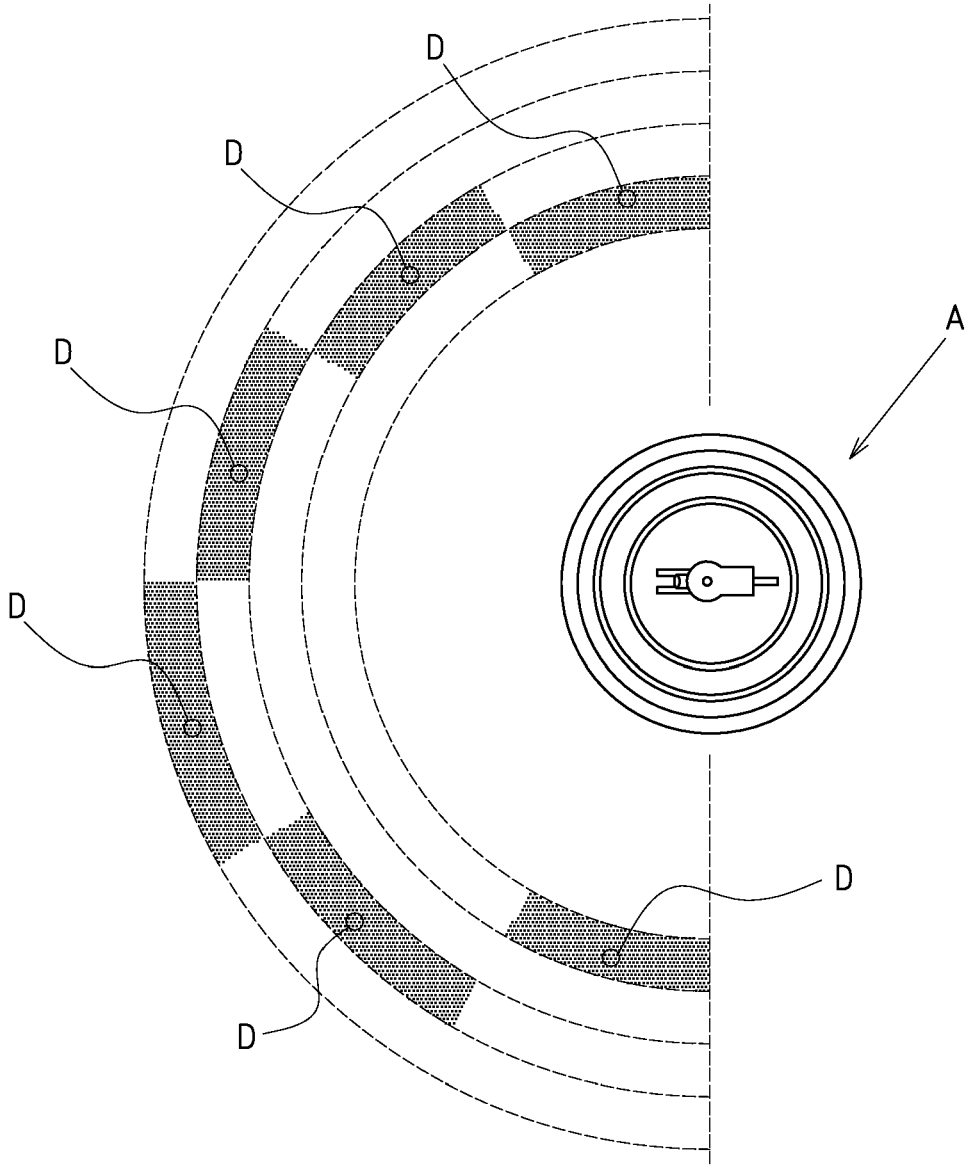
FIG. 7 is a schematic view of the irrigation range of the present invention.

Next, when the main body 30 is rotated, the discharge angle of the sprinkler head 33 can be adjusted. Referring to FIG. 4, with the mating of adjustable column 221 and locating hole 222 of the adjustor 22 set for the adjusting ring 20 (also disclosed in FIG. 1), the height of the spacing for the driving rod retaining surface 21 can be adjusted freely, such that when the main body 30 is rotated, the sprinkler head driving rod 50 will shift vertically along the circumferential path on the driving rod retaining surface 21 of the adjusting ring 20, and the sprinkler head 33 is driven to swing with change of the discharge angle. In such a case, spray with different sprinkling ranges (in collaboration with FIG. 7) can be generated, allowing to change spraying angle to form different parabolic sprinkling distance with more uniform sprinkling coverage. With the help of the adjusting ring 20, it is possible to meet diversified gardening irrigation purposes in irregular regions (shown by D in the figure).

I claim:

1. A percussion sprinkler having an adjustable discharge angle, the percussion sprinkler comprising:

a pedestal having a top and a bottom, said top of said pedestal having a setting surface thereon, said pedestal having an inlet tube extending from said bottom to said top;

an adjusting ring set onto said setting surface of said pedestal, said adjusting ring having a retaining surface and an adjustor received into said setting surface so as to set a height of said retaining surface; and a main body having a mating end at a bottom thereof, said mating end mated with said inlet tube, said main body having an upper frame, said main body having a sprinkler head adjacent a lower flange of said main body, said sprinkler head having a circumferential flange;

a percussion guide frame flexibly affixed onto said upper frame of said main body, said percussion guide frame having a hydraulic pusher bearing on a front end of said sprinkler head so as to urge said sprinkler head downwardly, said percussion guide frame having a torsional spring positioned above said sprinkler head so as to urge said sprinkler head downwardly, said hydraulic pusher and said torsional spring positioned on one side of said main body; and a driving rod having a first end and a second end, said first end of said driving rod linked to said circumferential flange of said sprinkler head, said second end of said driving rod slidably abutting said retaining surface of said adjusting ring, said driving rod having a fixed length and extending angularly outwardly and downwardly from said circumferential flange of said sprinkler head, said driving rod shifting vertically along said retaining surface as said main body is rotated so as to cause said sprinkler head to swing vertically so as to change said discharge angle thereof.

2. The percussion sprinkler of claim 1, further comprising: a foot stand affixed to said bottom of said pedestal.

3. The percussion sprinkler of claim 1, said first end of said driving rod linked to a bottom of said circumferential flange of said sprinkler head.

4. The percussion sprinkler of claim 1, said upper frame of said main body having a water inlet mating portion positioned onto a lower flange adjacent thereto, said sprinkler head having a rotary mating portion, said rotary mating portion having a locator, said water inlet mating portion having a water inlet and a locating bulge at both sides thereof, said locator being snapped onto said locating bulge when said sprinkler head is mated with said water inlet mating portion.

5. The percussion sprinkler of claim 1, said upper frame of said main body having a lower flange, said lower flange having a swinging set pivotally mounted thereto, said swinging set having a fixed seat and a rotary seat, said rotary seat having a shaft lever and a circumferential water passage, said fixed seat having a shaft hole sleeving said shaft lever, said sprinkler head protruding from said circumferential water passage such that said main body and said sprinkler head can swing freely in relation to said swinging seat.

6. The percussion sprinkler of claim 1, said adjusting ring being of an annular disc shape, said adjustor extending from a bottom of said adjusting ring.

7. The percussion sprinkler of claim 1, said adjustor comprising a plurality of adjustable column and a locating hole, said plurality of adjustable columns extending downwardly from said bottom of said adjusting ring in spaced relation to each other, each of said plurality of adjustable columns having a gear thereon, said gear being mated with said locating hole.

* * * * *